United States Patent [19]

Green

[11] 4,154,558

[45] May 15, 1979

[54] IMPULSE PUMP USING SPARK DISCHARGE TO ACTUATE FLUID LINK

[75] Inventor: Bert B. Green, Houston, Tex.

[73] Assignee: Green Impulse Corporation, Houston, Tex.

[21] Appl. No.: 803,126

[22] Filed: Jun. 3, 1977

[51] Int. Cl.[2] ..... F04B 9/10; F04B 43/12

[52] U.S. Cl. ..... 417/383; 417/394; 417/474

[58] Field of Search ..... 417/383, 394, 474, 52, 417/379

[56] References Cited

U.S. PATENT DOCUMENTS

| | | | |
|---|---|---|---|
| 2,291,912 | 8/1942 | Meyers | 417/394 |
| 2,916,200 | 12/1959 | Siegmund | 417/394 |
| 3,568,733 | 3/1971 | Lau | 417/394 |
| 3,586,461 | 6/1971 | Erlandson | 417/383 |
| 3,701,618 | 10/1972 | Wall et al. | 417/474 |

*Primary Examiner*—C. J. Husar
*Assistant Examiner*—Thomas I. Ross
*Attorney, Agent, or Firm*—Gunn & Lee

[57] ABSTRACT

An impulse pump is disclosed. In one embodiment, the impulse pump utilizes an elongate tubular outer housing which surrounds an axial passage. The axial passage is lined with a tubular resilient member. The resilient lining fits snugly against the wall of the housing except at an encircling annulus in the housing. The annulus is isolated. It is filled with a fluid material which dissociates when exposed to high temperatures as will occur in the formation of an electrical spark. An electrical spark is formed in the annulus to increase the pressure in the annulus. When this occurs, it increases so much that a bulge is formed in the flexible lining, and the bulge ripples along the flexible lining as a source of compression pumping. The pressure in the lining exceeds the back pressure of the fluid to initiate the pumping action.

7 Claims, 2 Drawing Figures

IMPULSE PUMP USING SPARK DISCHARGE TO ACTUATE FLUID LINK

BACKGROUND OF THE DISCLOSURE

This disclosure is directed to an impulse pump. It utilizes an external housing formed of metal which surrounds an axial passage, the passage being lined with an internal tubular sleeve. The tubular sleeve serves as a means of isolating the fluid that is pumped from the pumping apparatus. The impulse pump is useful in practically any circumstances where a fluid must be pumped. It can be oriented horizontally, for instance. However, the pump can be positioned where it pumps upwardly at any desired angle. The pump thus imparts a squeezing action to the fluid that is pumped. The squeezing action in particular resembles that imparted by hand milking a cow. On the cascading of two or three of the pumps in series, the squeezing action is performed in a first pump and thereafter occurs in a second pump. The timing, of course, is dependent on many scale factors, including spacing between consecutive pumps, the relative diameter of the axial passage and many other factors.

Pumps of this sort find application in many areas. For instance, the pump is able to move a fluid of almost any viscosity and including viscous slurries. This is accomplished without contacting the fluid pump with the pumping apparatus. Restated, the pump is lined with a resilient and, hence, chemically inert material, and it is, therefore, able to avoid contamination from the pumped material. Piston pumps, as an example, require lubrication of the piston, which introduces a lubricant which at least is found in trace quantities in the fluid to be pumped. It is possible to build a pump which leaks in the opposite direction, namely leakage of the pumped fluid through the piston rings, but this presents problems of its own. This pump avoids both problems.

The present invention is an impulse pump which utilizes the power delivered to the pump in the form of an electrical spark. The size, current, and frequency are scale factors. They can be varied depending on the requirements of the situation.

BRIEF DESCRIPTION OF THE DISCLOSED APPARATUS

This disclosure is an impulse pump. It is constructed in an elongate tubular housing having a resilient liner in the housing. The resilient liner is a sleeve which is clamped at both ends. It is immediately adjacent to the wall of the housing at both ends. Intermediate of the ends, an annulus is located in the housing on the exterior of the rubber sleeve. The annulus is able to receive, store and hold a fluid which is characterized by its ready dissociation on exposure to an electrical spark. An electrical spark is formed in the annulus by connecting conductors to the housing to an electrode which forms a spark. The housing is divided in two parts, and an insulative gasket isolates the parts. When the spark occurs, it liberates heat, and the electrical current flow of the spark in the isolated fluid causes atoms to dissociate from the compound. When dissociation occurs, there is a temporary increase in pressure. The increase is relatively shortlived. This is because the various atoms knocked free of the molecules during dissociation are exposed to one another, and, dependent on their chemical activity, they eventually recombine. The duration required for this depends on the rate at which recombination occurs. Hence, the spark causes an increase in pressure, thereby flexing the resilient lining with a squeezing action. The squeezing action works somewhat as a ripple. It ripples the wall of the resilient lining and thereby pumps the fluid from the pump.

DETAILED DESCRIPTION OF THE PREFERRED EMBODIMENT

Figure 1:
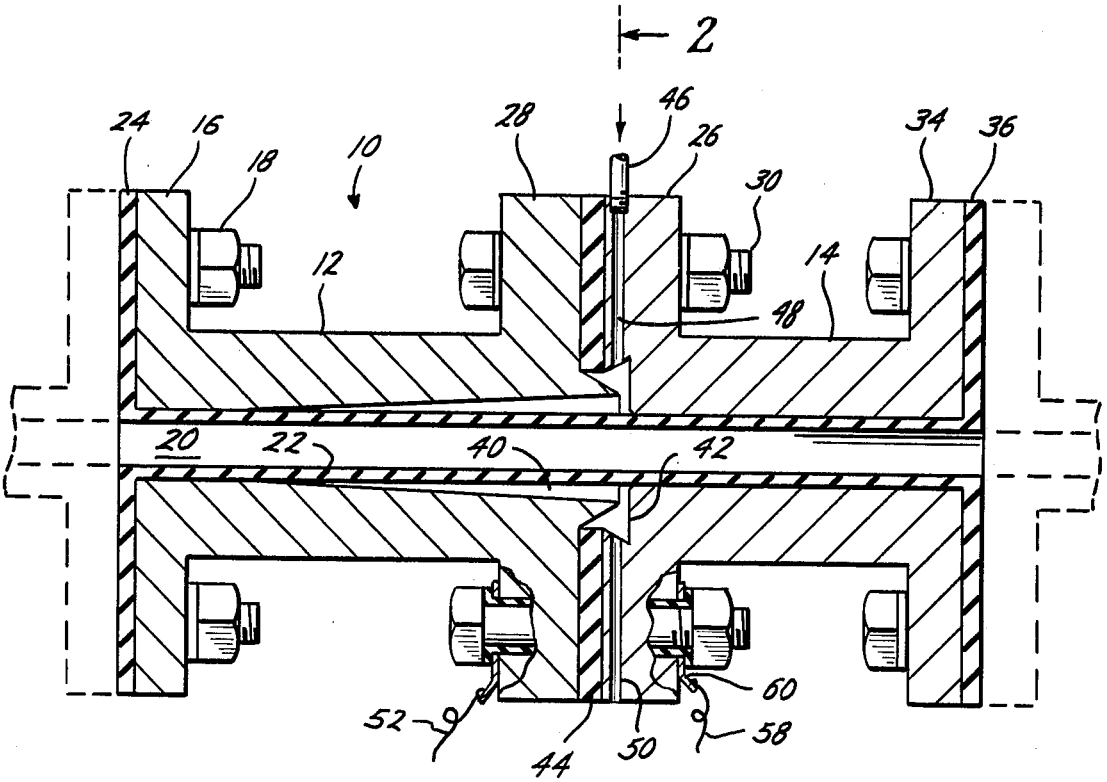
FIG. 1 is a sectional view along the axis of the impulse pump of the present invention showing details of construction of the impulse pump.
Figure 2:
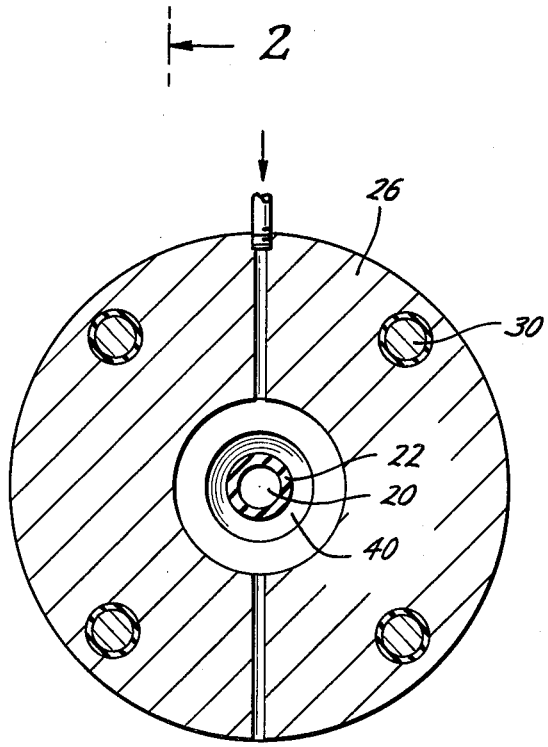
FIG. 2 is a sectional view along the line 2—2 showing details of the spark chamber.

Attention is first directed to FIG. 1 of the drawings where the numeral 10 identifies the impulse pump. It is formed of a first elongate tubular housing 12 and a second elongate tubular housing 14. The housing 12 is provided with an end flange 16. This enables it to be bolted or otherwise joined to a pipe or other fitting. The flange is joined to the adjacent fitting, pipe or other apparatus by a bolt 18 arranged in a bolt circle.

The tubular portion 12 is comprised of a major elongate cylindrical body which terminates in flanges at each end. The body has a central axial passage 20 formed in it. The passage is cylindrical, having a diameter for receiving a tubular lining 22. The lining is formed of resilient material. The lining terminates in an outwardly projecting circular end lip 24. The end lip is positioned adjacent to the flange 16. This enables it to be caught and pinched between end flanges which lock the tubular lining in position. The impulse pump 10 will be observed to be fully lined with a resilient and, hence, inert liner enabling the device to pump even corrosive materials.

The resilient lining 22 spans both portions 12 and 14. The portion 14 is constructed similar to the portion 12. The portion 14 includes a flange plate 26 at one end thereof, and it fronts and bolts to a matching flange plate 28 at the end of the tubular housing 12. The flanges 26 and 28 are joined together by suitable nuts and bolts 30 which thread through the two flanges at bolt holes arranged on a common bolt circle. The bolts are insulated to avoid shorting the two housing portions. The two flange plates thus join together and axially align the tubular housing portions 12 and 14 to receive the tubular lining 22 through both of them as a unit. The tubular housing portion 14 includes another flange plate 34 at the opposite end, which is also equipped with holes for receiving insulated bolts to anchor it to a connected pipe, fitting or the like. Normally insulative gaskets isolate the pump from the line. Again, the tubular lining 22 terminates in an outwardly directed lip 36 which is clamped when the impulse pump 10 is joined to the connecting apparatus, thereby anchoring the tubular lining at both ends.

Attention is next directed to a spark chamber 40 formed in the apparatus. The spark chamber is primarily formed in the tubular housing portion 12 and has an elongate concentric tapered portion therein. The taper thus separates the tubular sleeve 20. This forms an annular cavity which is wedge shaped in cross section as shown in the drawings and which is larger near the end where the flange plates join together. The taper extends through a substantial portion of the length of the tubular housing 12. The precise length and angle of taper is subject to variation, being scale factors in the present invention. The tapered portion of the spark chamber extends to an enlarged chamber defined by a facing wall 42. This wall is formed in the tubular housing 14.

It will be observed that the housing portions 12 and 14 join together in a fashion to define something of a doughnut shaped annular cavity portion at the end of the tapered cavity. The cavity is sealed against leakage by incorporating a gasket 44 between the two flange plates. The gasket 44 seals against both flanges and prevents leakage. A tubing 46 is threaded into and joined to a radially drilled passage 48 which connects into the spark chamber 40. This enables the spark chamber 40 to be evacuated and subsequently filled with a suitable dissociative fluid which responds to the spark to be described. In addition, another radially drilled passage 50 communicates to the spark chamber.

An electrical conductor 52 is connected to one portion of the housing. It is shown connected to the left hand side of the gasket 44. A conductor 58 is connected to the right side. The conductor 58 is connected to a connective strap 60 joined to the other portion of the housing. The two portions of the housing are insulated from one another by the gasket 44. The potential difference applied across the two portions is sufficient to form a spark depending on many scale factors. It will be observed that the left hand housing portion has a ring shaped sharp edge facing the planar wall 42. Sparks jump from the sharp edge to the facing wall. The spark may occur at any point around the circumference. So to speak, the spark is localized at its inception, and it may or may not develop into sheet lightning around the sharp-edged ring. This provides a more than ample spark electrode. The electrode may be damaged if all the sparks jump from a single point. Because they jump from any point on the sharp edge, there is little likelihood of corrosion at the spark gap.

The foregoing has set forth many of the structural components of the apparatus. Its operation is in the following manner. Briefly, the spark chamber 40 is evacuated. It is filled with a suitable nonflammable gas or liquid formed of at least two atoms which dissociate and then recombine. Dissociation is achieved by the spark which is formed in the spark chamber 40. Water is one type of material which dissociates. When current flows through water, dissociation occurs at the positive and negative poles by electron interchange and also at the length of the spark by plasma. The hydrogen and oxygen which are liberated by dissociation subsequently recombine because they are kept in solution in the spark chamber. However, the dissociation forms gases having a larger volume than the volume of the combined gases in liquid form. This increases the pressure in the spark chamber 40. The increase in pressure squeezes the resilient tubing 22. The squeeze is quite large at the large tapered end of the cavity 40. At the opposite end, the expansion of the gases in the small end of the tapered cavity is much less and, hence, the flexure of the tubular member is much less. In other words, pressure increase in the spark chamber is relieved by a large bulge which is formed in the tubular member 22. The bulge is large at the larger portions of the spark chamber 40. It is proportionately smaller at the thin tapered end shown at the left of the drawings. The bulge arrives at the remote end of the cavity after some delay. Let it be understood that this bulge fully encircles the flexible tubular member 22. It is not localized, and does act all the way around. So to speak, a fully encircling squeezing action occurs at the large end of the spark chamber 40, and this is reduced but still fully encircles even at the other end of the spark chamber.

The bulge is formed as rapidly as pressure is increased in the spark chamber. This rapid increase results in a wave of pressure from right to left as viewed in FIG. 1 of the drawings. The pressure is relieved after the spark ends. It is relieved as rapidly as recombination occurs in the liquid in the spark chamber 40. This is reasonably rapid dependent on the particular material chosen, the operating temperature, the degree of turbulence occurring in the spark chamber and other factors. As the pressure drops, the bulge or deformation of the resilient lining 22 shrinks and disappears. As an example, it may take from a few nanoseconds up to one or two microseconds for the pressure to drop enough that the elastic liner 22 is restored to its relaxed state. As an example, pulsating flow through the pump can be obtained by providing a pulse to it once every ten milliseconds. This permits the resilient lining 22 to return to its depicted condition.

It is possible to cascade several pumps. Dependent on many scale factors, electrical sparks can be applied to different impulse pumps at differing times to cascade the pumping action. For instance, several can be connected in series and thereby pump from right to left in the same manner as shown in the drawings. When this occurs, the flow of the pumped material will be characterized by pressure surges and the consequential movement. It is possible to time the impulses at the multiple pumps so that the pressure surges do not occur simultaneously but are serially slightly overlapped with one another. In this event, reasonably steady flow at the end of the multistage pump can be obtained. It should be kept in mind that the surge of pressure occurring in the spark chamber 40 causes a flow of pumped material from right to left. The large bulge which is formed at the larger end of the spark chamber 40 is accompanied by movement to the left. There will be slight movement of material to the right, but the bulk of the movement is to the left. Changes and modifications can be made in the device. More specific spark gap electrodes can be incorporated. It is possible to make the tip of the ring which provides the sharp edge from a material more resistent to damage by continual sparking. It is also possible to provide suitable electrodes on the face 42 for the same purpose. This is not normally necessary. It can be accomplished only at increased cost and complexity. It is possible to add additional features at increased cost which factor must be taken into account in the construction of the pump.

A suitable voltage source operates somewhat in the same fashion as a power supply for a flash attachment on a camera. Specifically, a large bank of condensors having a capacitance for storing a large electrical charge is connected to the conductors 52 and 58. The spark is formed by discharging the capacitors to the conductors 52 and 58. While the average power consumed by the pump may be low, the peak power is determined primarily by the current flow over a very short duration typically in the millisecond range. Instantaneous power delivered can be very substantial to achieve a significant pumping action.

The spark chamber can be shaped as drawn or otherwise. The shape illustrated appears to focus the energy toward the resilient liner. The shape can be tailored to pick up particulates in the pumped fluid also. Indeed, the pumped fluid may, in some cases, be unaltered by the shock wave first occurring before the pressure build-up, and the shock wave will assist by displacing particulates prior to the pumping motion.

The foregoing is directed to the preferred embodiment of the present invention; the scope thereof is determined by the claims which follow.

I claim:

1. An apparatus for impulse pumping a fluid, comprising:

(a) an elongate axially hollow tubular housing;

(b) a resilient, flexible liner positioned in the axial passage of said housing;

(c) an annular cavity between said liner and said housing, said liner and housing isolating said cavity from communication to the exterior such that said cavity is a closed chamber;

(d) a spark gap in said cavity which incorporates a pair of spaced electrical terminals to create a spark in said cavity on applying a suitable voltage to said spark gap which spark, dependent on its magnitude and duration, produces expansive pressures of a fluid in said cavity which pressures flex said liner to form a bulge of said liner and thereby expel fluid in the passage of said housing;

(e) wherein said housing comprises first and second housing portions which abut one another and which additionally define said cavity at their respective end portions which abut one another; and (f) wherein said first and second housing portions are electrically isolated from one another by an insulative gasket placed therebetween and wherein said first and second housing portions are connected to electrical conductors to apply a voltage through said housing portions to said spark gap.

2. The apparatus of claim 1 wherein said annular cavity is, in cross section, elongate and concentric about said liner and said cross section is tapered to define a thin end portion and an enlarged opposite end.

3. The apparatus of claim 2 including a radially directed passage means through said housing for connection to said spark gap to place a dissociative fluid therein.

4. The apparatus of claim 2 wherein said cavity tapers to the small end and the opposite end includes an enlarged ring.

5. The apparatus of claim 4 wherein said cavity locates said ring at the joinder of a pair of separable housing portions which assemble axially to one another and thereby define said housing.

6. The apparatus of claim 5 including a flange on said housing portions for assembling said portions.

7. The apparatus of claim 6 including first and second end located flanges on said housing.

* * * * *